United States Patent [19]

Potzas

[11] Patent Number: 4,872,332

[45] Date of Patent: Oct. 10, 1989

[54] METHOD AND DEVICE FOR SETTING BLIND RIVETS

[76] Inventor: Peter Potzas, AM Rinnerborn 58, D6305 Alten-Buseck Bundersrepublik Deutschland, Fed. Rep. of Germany

[21] Appl. No.: 220,398

[22] Filed: Jul. 18, 1988

Related U.S. Application Data

[63] Continuation of Ser. No. 40,771, Mar. 24, 1987, abandoned.

[30] Foreign Application Priority Data

Sep. 4, 1985 [DE] Fed. Rep. of Germany ..... 3531532

[51] Int. Cl.[4] ..... B21D 41/02

[52] U.S. Cl. ..... 72/393; 72/370; 29/446

[58] Field of Search ..... 72/391, 393, 114, 370; 29/243.53, 243.52, 446, 157.3 L

[56] References Cited

U.S. PATENT DOCUMENTS

| | | | |
|---|---|---|---|
| 2,367,265 | 1/1945 | Cooper et al. . | |
| 2,430,554 | 11/1947 | Bugg . | |
| 2,446,713 | 8/1948 | Melick . | |
| 2,605,011 | 7/1952 | Volpe . | |
| 3,763,541 | 10/1973 | Jaffe | 72/391 |
| 4,140,000 | 2/1979 | Ehmann | 72/391 |
| 4,386,515 | 6/1983 | Starke | 72/391 |
| 4,597,282 | 7/1986 | Hogenhout | 72/393 |
| 4,665,732 | 5/1987 | Hogenhout | 72/393 |

FOREIGN PATENT DOCUMENTS

| | | |
|---|---|---|
| 2203217 | 7/1973 | Fed. Rep. of Germany . |
| 419095 | 11/1934 | United Kingdom . |
| 451396 | 8/1936 | United Kingdom . |

*Primary Examiner*—David Jones
*Attorney, Agent, or Firm*—Browdy and Neimark

[57] ABSTRACT

In the setting of blind rivets, the rivets are placed onto a riveting mandrel having a thickened end, the diameter of which is larger than the diameter of the rivet hollow space, in such a way that the rivet head rests on the side remote from the thickened end. Then the rivet, together with the riveting mandrel, is inserted into the bores of the structural parts. The rivet head is then supported by a holding-down part. Finally the riveting mandrel, for opening-out the rivet end projecting through the bores, is displaced against the pressure direction of the holding-down part. In order to be able to reuse the riveting mandrel and to thereby simplify the riveting method and make it less expensive, the thickened end of the riveting mandrel, after adequate opening-out of the free rivet end, is reduced in diameter until it fits through the rivet hollow space, and subsequently the riveting mandrel, at the head side of the rivet, is pulled out of the cylindrical rivet hollow space and reused for the next setting operation. The method is carried out with a rivet tool, into which the riveting mandrel is integrated.

22 Claims, 6 Drawing Sheets

METHOD AND DEVICE FOR SETTING BLIND RIVETS

This application is a continuation of application Ser. No. 040,771, filed 3/24/87, now abandoned.

BACKGROUND OF THE INVENTION

The invention relates to a method of setting blind rivets provided with cylindrical, continuous hollow spaces, preferably for connecting structural parts which are accessible only on one side and are provided with bores in alignment with one another, the blind rivet being placed in such a way onto a riveting mandrel having a thickened end, the diameter of which, at least in one dimension, is larger than the diameter of the rivet hollow space, that the rivet head rests on the side remote from the thickened end, the rivet then being inserted, together with the riveting mandrel, into the structural part bores, in alignment with one another, until the rivet head rests on the surface of the outer structural part, the rivet head then being supported by a holding-down part and finally the riveting mandrel, for opening out the rivet end projecting through the bores, being moved against the pressure direction of the holding-down part, and also a device for implementing this method.

Blind riveting methods are used for riveting structures which are accessible only from one side, for example in coach work and small tank construction in the case of double-shell methods of construction and the like.

In a known blind riveting method of the above-mentioned type, a blind rivet is used with an inserted riveting mandrel. In this method, the thickened end of the riveting mandrel lies directly in front of the free rivet end to be opened out and the mandrel is provided with a predetermined breaking point at a distance from the thickened end. On the head side of the rivet, the riveting mandrel projects a short length out of the rivet hollow space. The blind rivet is set by means of manual riveting tongs or a compressed-air-actuated riveting tool by the holding-down part being pressed onto the head of the inserted rivet and the riveting mandrel being acted upon by a tensile force in the direction out of the rivet hollow space. When a certain tensile force is applied, the free rivet end is opened out and, once the opening-out operation has been carried out, the riveting mandrel breaks off at the predetermined breaking point. Whereas the riveting mandrel part provided with the thickened end remains in the opened-out end of the blind rivet, or falls off inwards, the riveting mandrel part sitting in the riveting tool is removed and thrown away.

Although this known riveting method is very reliable, it is relatively expensive because all of the rivets have to be provided with a riveting mandrel which, after execution of the operation, is a scrap product.

SUMMARY OF THE INVENTION

The object of the invention is to modify the blind riveting method of the type mentioned at the beginning, while retaining all of the advantages, to the effect that the auxiliary riveting mandrels available in each rivet can be dispensed with and the riveting method can thereby be simplified and made less expensive.

This object is achieved according to the invention in that the thickened end of the riveting mandrel, after adequate opening out of the free rivet end, is reduced in diameter until it fits through the rivet hollow space, and that the riveting mandrel, on the head side of the rivet, is subsequently pulled out of the cylindrical rivet hollow space and reused for the next setting operation.

This method has the advantage that only a single riveting mandrel is required which can be reused for each setting operation. It is therefore also possible to integrate the riveting mandrel into the riveting tool. In using the method according to the invention, the blind rivet blanks can be supplied as simple hollow rivets without an expendable riveting mandrel needing to be contained in each rivet blank.

A further advantage of the method according to the invention is that the degree of opening out of the rivet end can be controlled. Whereas in the known riveting method a specified tensile force has to be exerted on the expendable riveting mandrel in order to part the latter at its predetermined breaking point, when applying the method according to the invention the tensile force can be varied according to the particular application, for the riveting mandrel can be released at any time by the cross-sectional reduction in the riveting mandrel end. For example, by prematurely interrupting the opening-out operation, even relatively loose riveted joints can be made, which can be used, for example, as hinge locations.

The method according to the invention is also particularly simple in implementation and can easily be implemented even by unpractised persons. For each setting operation, the blind rivets can be placed individually onto the riveting mandrel, namely directly onto the working end, for the latter can be reduced in diameter for pushing on the particular rivet.

The device for implementing the method according to the invention is a tool having a riveting mandrel with a thickened end, the diameter of which, at least in one dimension, is larger than the diameter of the cylindrical rivet hollow space, having a holding-down part with a central bore in which the riveting mandrel is guided in axially displaceable manner, and also having a pulling device for displacing the riveting mandrel in the direction out of the rivet hollow space. The device according to the invention is characterized in that the riveting mandrel is formed from at least two flexible tongues which extend in the mandrel longitudinal direction and, at their free ends, on their sides pointing radially outwards, have projections (7) which form the thickened end, that a supporting element (6) which also extends in the mandrel longitudinal direction is provided between the tongues, which supporting element is displaceable in the longitudinal direction of the riveting mandrel relative to the tongues, and that the supporting element, at least for opening out the rivet end, can be located in a position which is pushed forwards relative to the tongues and in which it is also located between the free ends of the tongues provided with the projections, and, for pulling the mandrel out of the rivet hollow space after the rivet end is opened out, can be moved into a pulled-back position in which the tongue ends provided with the projections can be tilted towards one another.

The riveting mandrel can have two tongues, the cross-section of which has the shape of a circular segment, whereas the supporting element has a flat, rectangular cross-section, the width of which approximately corresponds to that of the tongues. In the case of a larger rivet diameter, even more than two tongues can be provided, the supporting element being a polygon in accordance with the number of tongues.

The holding-down part and the riveting mandrel are preferably parts of riveting tongs, the holding-down part being firmly fixed to the working end of the tong housing, and it being possible to actuate the tongues on the one hand and the supporting element on the other hand independently of one another.

The movements of the tongues and the supporting element can be adapted to one another dependent on the setting operation. In this way, it is possible to accurately adjust the tightness of the set rivet.

The tongues and the supporting element are expediently pretensioned via a common spring device into their position extended the furthest out of the holding-down part, and the riveting mandrel parts can be displaced via a common drive mechanism, in which case the riveting mandrel parts can be individually uncoupled selectively from the drive mechanism, dependent on the setting operation.

As a drive mechanism, a drivable piston which is guided in the axial direction of the riveting mandrel can be provided, mounted in a guide channel made in the tong housing. Moreover, a piston bearing the tongues can be arranged on the side of the drive piston pointing towards the working end of the riveting tongs, whereas a slave piston is additionally provided on the side of the drive piston remote from the working end. At the same time, the supporting element expediently extends through central bores provided in all three pistons, projects through the slave piston and bears with a head against the side of the slave piston remote from the working end. These three pistons can be coupled to one another selectively, dependent on the rivet setting operation in order to execute optimally the setting operation.

For placing a rivet onto the riveting mandrel, the slave piston can be locked in the area of the guide channel remote from the working end, whereas the drive piston can be moved together with the tongue piston in the direction of the working end of the tool, so that the tongue ends can bend towards one another, as a result of which the thickened end is reduced in cross-section to such an extent that the riveting mandrel fits through the rivet hollow space.

For opening out the rivet end, all three pistons can be coupled to one another and moved away from the working end of the tool.

The piston bearing the tongues can be uncoupled from the drive piston after the opening-out operation is complete.

The tongue piston can be re-coupled to the drive piston in order to pull the riveting mandrel out of the rivet hollow space.

The uncoupling and subsequent re-coupling of the tongue piston to the drive piston can preferably be effected dependent on the position of the drive piston and can be selectively adjustable. By this measure, the effective opening-out distance of the riveting mandrel and therefore the tightness of the rivet seat is controlled.

If the device according to the invention is to be designed as manually operable tongs, one tong leg can be rigidly connected to the tong housing, whereas the other tong leg, forming a two-arm lever, is articulated on the tong housing, the short lever, with a fork-shaped end, engaging into a slave recess of the drive piston.

BRIEF DESCRIPTION OF THE INVENTION

The invention is illustrated by way of example in the drawing and described below in detail with reference to the drawing, in which:

FIGS. 1,2,3,4,5,6,7 and 8 show the various stages of the blind rivet blank up to the set rivet and also the individual working positions of the tool, FIG. 9 shows the working end of the riveting mandrel on an enlarged scale, FIG. 10 shows a section along the line X—X from FIG. 9, FIG. 11 shows a view of riveting tongs, FIG. 12 shows on an enlarged scale a longitudinal section through the upper part of the riveting tongs according to FIG. 11, and FIG. 13 shows a section along the line XIII—XIII from FIG. 12, with the riveting mandrel and the drive mechanism of the mandrel shown in plan view.

DETAILED DESCRIPTION OF THE PREFERRED EMBODIMENTS

Figure 1:
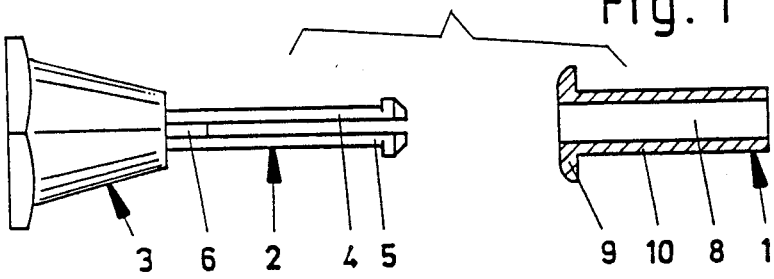

As follows in particular from FIGS. 1 to 10, the important part of the riveting tool, which part is functionally required for setting a blind rivet 1, consists of a riveting mandrel 2 and a holding-down part 3 in which the riveting mandrel 2 is guided in an axially displaceable manner. The riveting mandrel 2 is made up of three parts, namely two outer tongues 4 and 5 and also a supporting element 6 arranged between them. The tongues 4 and 5, which extend in the longitudinal direction of the riveting mandrel 2, have a constant cross-section over their length which has the shape of a circular segment, the two flat sides being turned towards one another and bearing against the supporting element 6. The supporting element 6 likewise has a constant cross-section over its length which has the shape of a flat rectangle. At the same time, the width of the rectangle approximately corresponds to the width of the tongues. At their free ends, the two tongues 4 and 5 have projections 7 which are directed radially outwards and together form a thickened riveting mandrel end. The projections 7 on each tongue have a semi-circular configuration, so that they form a circular cross-section when the tongues 4 and 5 are placed against one another.

The riveting mandrel 2 is arranged in a longitudinally displaceable manner relative to the holding-down part 3. In addition, however, relative displacement of the supporting element 6 is possible relative to the two tongues 4 and 5 in their longitudinal direction, but with the two tongues 4 and 5 only being movable together.

The drive mechanism of the riveting mandrel 2 or the tongues 4 and 5 and also the supporting element 6 is arranged inside the riveting tongs shown in FIGS. 11 to 13 and will be described in detail later. First of all, however, the functional sequence of the blind riveting method is to be described with reference to FIGS. 1 to 8.

For the method according to the invention, a simple blind rivet 1 is used which has a cylindrical, continuous hollow space 8 and is provided at one end with a flange-like head 9 which projects radially from the tubular rivet shank 10. The blind rivet can be made, for example, of an easily deformable aluminum alloy, but other materials are also possible depending on the particular application.

Figure 2:
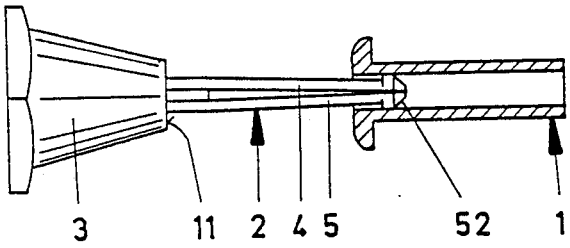

At the start of the method, the blind rivet 1 is placed onto the riveting mandrel 2. To make placement possible, the supporting element 6 is pulled back, so that both flexible tongues 4 and 5, as shown in FIG. 2, can be pressed together forwards. The thickened end of the mandrel 2 is thereby reduced in diameter, and in fact the at first elongated cross-section is converted into a circular cross-section which fits with slight clearance through the cylindrical hollow space of the rivet 1.

Figure 3:
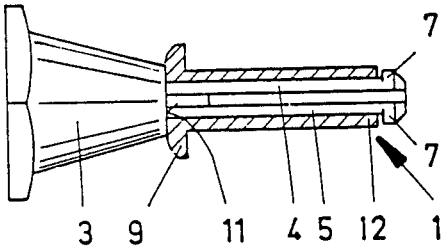

As shown in FIG. 3, the blind rivet 1, with its head 9 in front, is pushed onto the riveting mandrel 2 until the head 9 bears against the pressure face 11 of the holding-down part 3. In this position, the thickened end of the riveting mandrel 2 projects out of the end 12 to be opened out of the blind rivet 1, so that the tongues 3 and 4 can swing outwards again and assume a straight position. At the same time, the projections 7 grip behind the end 12 of the blind rivet 1.

Figure 4:
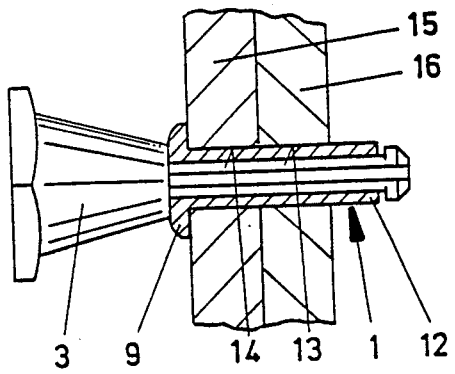

As shown in FIG. 4, the supporting element 6 is then pushed forward again, so that the ends of the tongues 4 and 5 can no longer be pressed together. The blind rivet 1 now sits firmly on the riveting mandrel 2 and can no longer be pulled off the latter. The hollow space 8 of the blind rivet 1 is essentially filled by the riveting mandrel 2.

In this condition, the blind rivet 1 sitting on the riveting mandrel 2 is inserted into bores 13 and 14 in alignment with one another of two structural parts 15 and 16 bearing against one another. These are structural parts of which only the outer structural part 15 is accessible, whereas the inner structural part 16 is located, for example, inside the hollow space. The blind rivet 1 is inserted into the bores, in alignment with one another, to such an extent that its head 9 rests on the outer surface of the outer structural part 15. At the same time, the end 12 to be opened out of the blind rivet 1 projects beyond the inner surface of the inner structural part 16.

Figure 5:
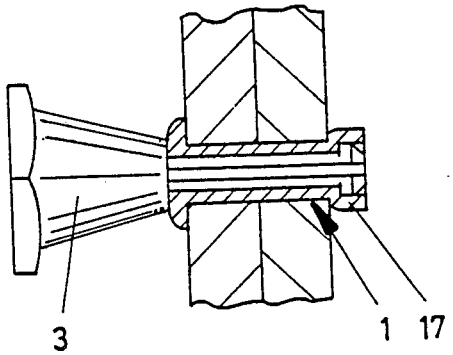

The actual setting operation of the rivet 1 takes place at the stage shown in FIG. 5. In this stage, the holding-down part 3 is pressed firmly against the rivet head 9, while at the same time the riveting mandrel 2 is pulled in its entirety a short length into the holding-down part 3 by means of a pulling device to be described later. Moreover, the projections 7 abut against the end to be opened out 12 of the blind rivet 1 and deform the blind rivet 1 into the bulge 17 shown in FIG. 5.

Figure 6:
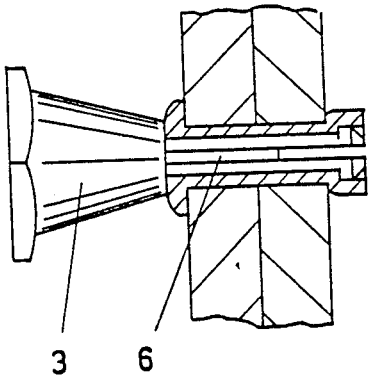
Figure 7:
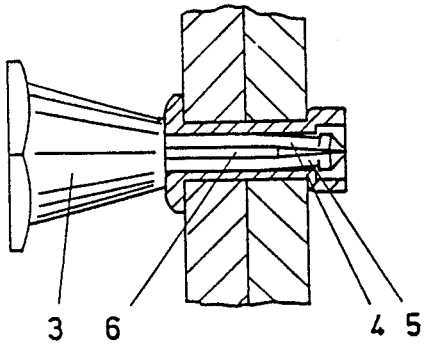
Figure 8:
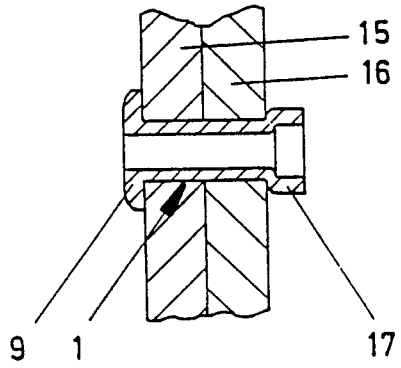
Figure 9:
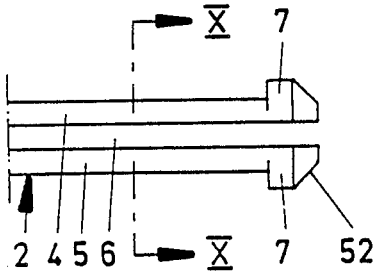
Figure 10:
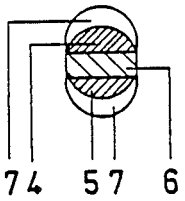

Once the opening-out operation is complete, the supporting element 6, as shown in FIG. 6, is pulled a short length into the holding-down part 3, so that the free ends of the tongues 4 and 5 can be tilted towards one another again and the thickened end of the riveting mandrel 2 can be reduced in its diameter. The riveting mandrel 2 is then pulled towards the holding-down part through the rivet hollow space shown in FIG. 7, and the riveting operation is complete. The result of the riveting is shown in FIG. 8, the two structural parts 15 and 16 being firmly connected to one another via the blind rivet 1. Depending on the length adjustment of the displacement distance of the riveting mandrel 2 during the setting operation, the seat of the blind rivet 1 can be adjusted so that it is tight or less tight.

Figure 11:
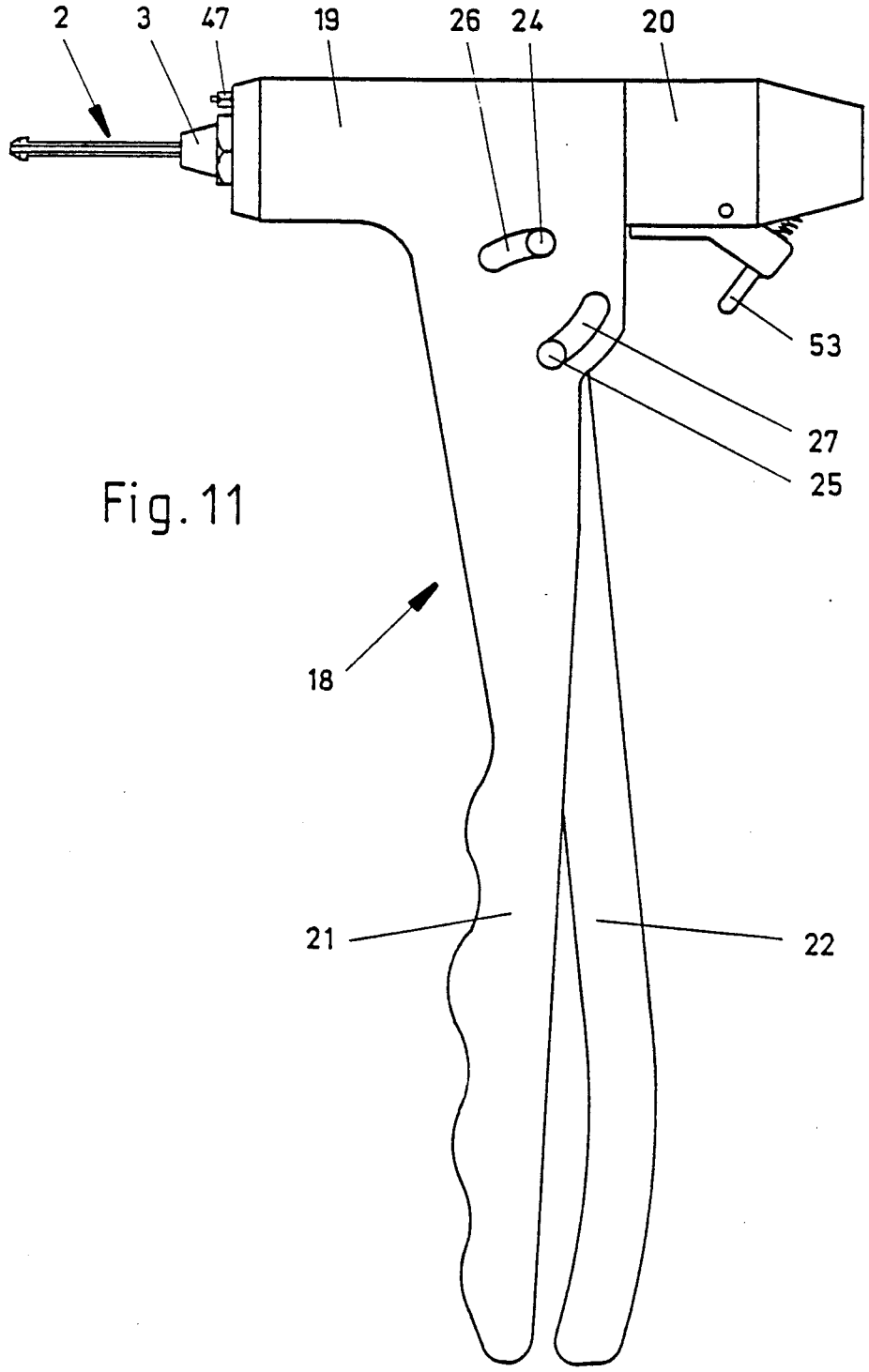
Figure 12:
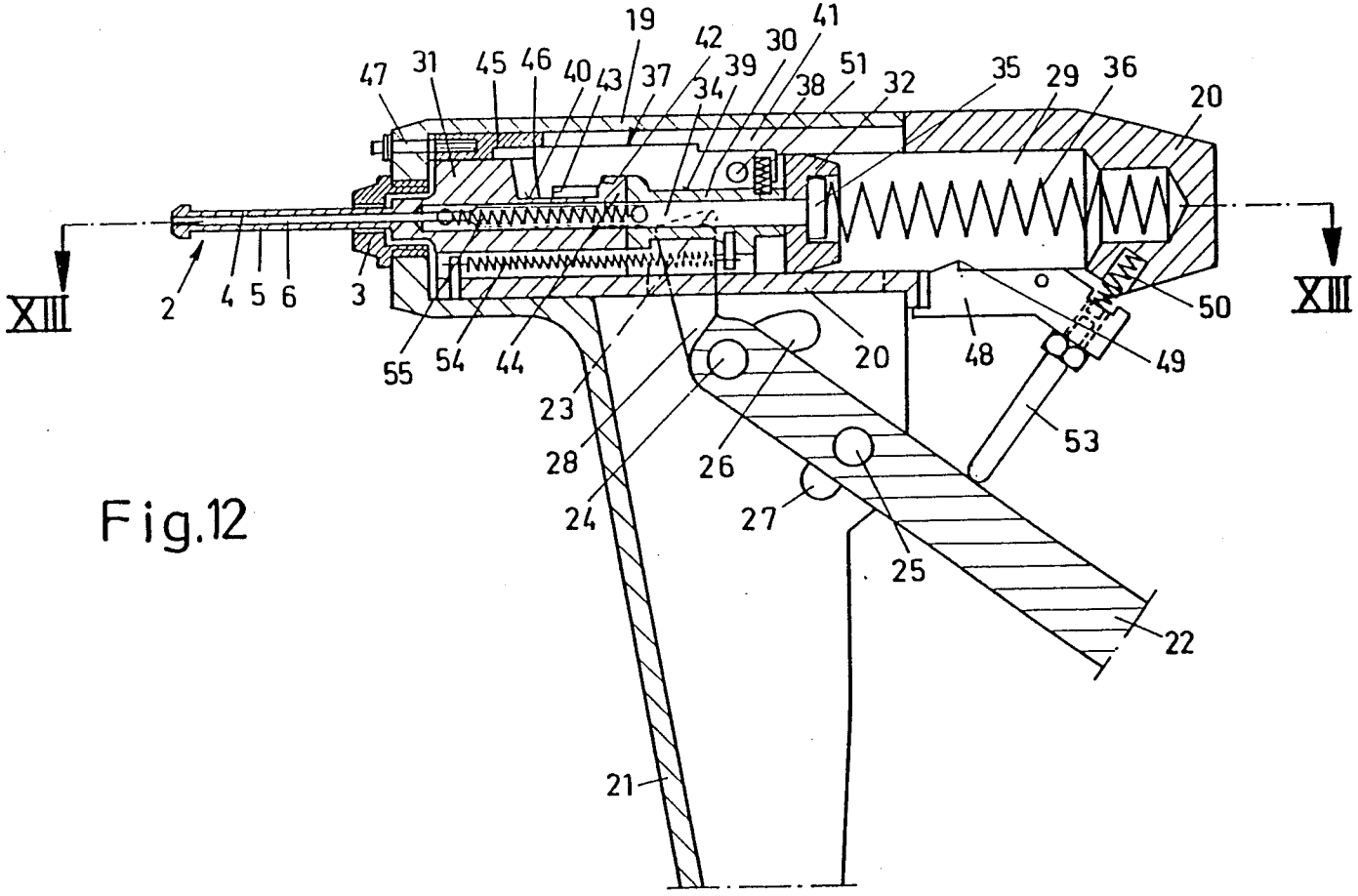
Figure 13:
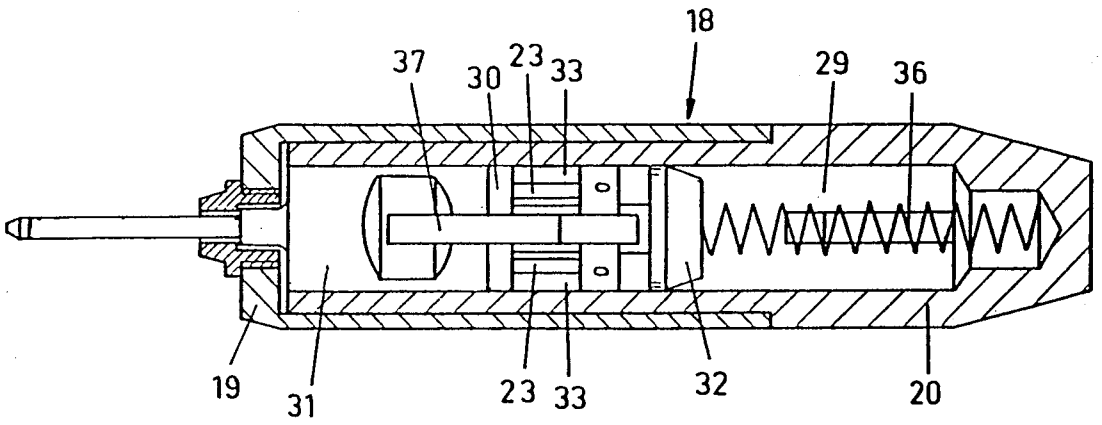

FIGS. 11 to 13 show in detail an exemplary embodiment of a riveting tool in the form of riveting tongs 18 to be actuated manually.

The riveting tongs 18 essentially consist of two approximately cylindrical housing parts 19 and 20 which are inserted one into the other. A rigid handle 21 is integrally formed on the outer housing parts 19 on which the holding-down part 3 sits. This handle 21 is of an approximately U-shaped configuration in cross-section, the two U-legs forming an accommodation space for a hand level 22 which is pivotably mounted between the two U-legs and, with a fork-shaped actuating end 23, engages into the inside of the housing 19, 20. The hand lever 22 is mounted between the U-legs of the handle 21 via two mounting pins 24 and 25 which are arranged at a distance from one another, project laterally on both sides beyond the hand lever and engage into arc-shaped slotted holes 26 and 27 made in the U-legs of the handle 21. As a result of this design, the upper, short lever arm 28 of the hand lever 22 is subdivided, as a result of which there is the advantage that the pivot angle of the hand lever 22 need not be excessively large but on the other hand a high force-transmission ratio is available, at least for a short duration, for manipulating operations which can be applied with greater force.

The two housing parts 19 and 20 are essentially of cylindrical configuration, right-hand housing part 20 being inserted on one side into the left-hand housing part 19.

The inner space 29 of the housing part 20 is essentially of cylindrical configuration and serves to accommodate three pistons guided in the axial direction, namely a central drive piston 30, a piston 31 arranged on the side pointing towards the working end of the riveting tongs 18 and bearing the tongues 4 and 5 of the riveting mandrel 2, and also a slave piston 32 arranged on the side of the drive piston 30 remote from the working end.

The drive piston 30 has two lateral recesses into which engages the fork-like actuating end 23 of the hand lever 22, which projects through an opening or inner space 29 into the inside of the housing, so that the drive piston 30, when the hand lever 22 is pivoted relative to the handle 21, is displaced in the axial direction of the housing 19 and 20. The two other pistons, namely the tongue piston 31 and also the slave piston 32, bear laterally against the drive piston 30 and can be coupled to the latter when required and can therefore be displaced together with the latter.

At its part running in the inside of the housing, the supporting element 6, which is flat at the working end and runs between the tongues 4 and 5, merges into a slightly thicker cylindrical portion 34. The latter extends through central bores provided in all three pistons 30, 31 and 32 and, with a widened head 35, bears against the side of the slave piston 32 remote from the working end. The head 35 of the supporting element 6 is acted upon by a powerful compression spring 36 which is supported against the closed end of the housing part 20 remote from the working end. In certain operating cases, all three pistons are thrust in the working direction by the compression spring 36, so that the entire riveting mandrel 2, including the tongues 4 and 5 and the supporting element 6, project far out of the holding-down part 3. This operating condition corresponds to the riveting mandrel position, shown in FIG. 4, immediately before applying the tensile force required for setting the rivet. This tensile force is applied by a pressure being applied to the hand lever 22 in the position shown in FIG. 12, as a result of which pressure the hand lever 22 is pivoted in the direction of the handle 21. Because of the displacement of the drive piston 30 away from the working end, the slave piston 32 is moved in the same direction, as a result of which the inner supporting element 6 is also driven along. The tongue piston 31 is likewise driven along, namely via a slave lever 37, so that the tongues 4 and 5 are at the same time also moved uniformly with the supporting element 6 into the holding-down part 3.

The slave lever 37 is pivotably fixed to the drive piston 30 via a pin articulation 38, is partly embedded into radial recesses of the pistons 30 and 31 and partly projects radially beyond the pistons, namely into a slot-shaped recess 41 of the housing part 20. On its side bearing against the tongue piston 31, the slave lever 37 has two stepped offset portions 42 and 43 which can effect a coupling with the tongue piston 31. For coupling, in each case one of the two stepped offset portions 42 and 43 grips over a catch lug 44 provided on the tongue piston 31.

In the operating case shown in FIG . 12, the offset portion 42 of the slave lever 37 lying nearer to the supporting articulation 38, grips over the catch lug 44, so that a fixed coupling is achieved between the pistons 30 and 31 bearing against one another. Uncoupling in this operating condition is not possible, since the pivotably mounted slave lever 37 is secured in its lower, coupled position by means of a holding-down stirrup 45 arranged in the housing recess 41.

The holding-down stirrup 45 extends only over one part of the displacement distance of the slave lever 37. If the end edge 46 of the slave lever 37 leaves the holding-down stirrup 45 after a certain displacement distance, the coupling between the drive piston 30 and the tongue piston 31 is released by the stepped offset portion 42 sliding over the catch lug 44, of bevelled configuration, as a result of which the slave lever is raised to such an extent that the stepped offset portion 42 slips away over the catch lug 44.

When the drive piston 30 is moved further forwards, the tongue piston 31 stops; that is, of the riveting mandrel parts, only the supporting element 6 moves towards the right in the drawing, whereas the tongues 4 and 5 remain in their position. If the second stepped offset portion 43 of the slave lever 37 comes into contact against the catch lug 44 when the drive piston 30 is moved further forwards, the tongue piston is again driven along, that is, the tongues 4 and 5 now also move further to the right together with the supporting element 6. The coupling between the two bevelled faces of the catch lug 44 and the stepped offset portion 43 is maintained by the slave lever 37 not being able to deviate upwards, because it butts against the inner wall of the outer housing 19. At the moment of renewed coupling, the supporting element 6 and the two tongues 4 and 5 are again displaced uniformly to the right. As shown in FIG. 7, this movement is utilized for pulling the riveting mandrel 2 out of the set rivet 1. Since the supporting element 6 is located in the pulled-back position, the two tongues 4 and 5 can be bent inwards and the thickened end pulled through the rivet hollow space.

Because of the sliding off of the end edge 46 of the slave lever 37 from the holding-down stirrup 45, the opening-out process is interrupted, for the tongues 4 and 5 no longer move in the direction of the holding-down part 3. In order to adjust the distance which the tongues 4 and 5 cover for opening out the rivet end and therefore to control the tightness of the rivet seat, the holding-down stirrup 45 is adjustably arranged. The holding-down stirrup 45 is arranged in an axially displaceable manner in the recess 41 of the housing part 20 and can be displaced by means of an adjusting screw 47 which is accessible from outside the housing. The further the holding-down stirrup 45 is displaced to the right in FIG. 12, the tighter becomes the rivet connection, since the opening-out distance is consequently increased.

If the drive piston 30 is moved still further to the right after the tongue piston 31 is coupled on again, the slave piston 32, which drives the supporting element 6 along against the force of the spring 36, slides over a spring-loaded locking lever 48 which engages with a catch stop 49 behind the slave piston 32 and secures the latter. A compression spring 50, which is supported against the housing part 20, ensures that the catch stop 49 remains in its locking position.

If the hand lever 22 is now moved away from the handle 21 when the slave piston 32 is engaged, the drive piston 30 is moved to the left in the drawing, whereas the slave piston 32 remains in its catch position. At the same time, the tongue piston 31, by means of a tension spring 55 which is secured in position between the drive piston 30 and the tongue piston 31, is pulled up towards the drive piston 30 until it comes into contact against the latter. The slave lever 37, which is pretensioned by means of a compression spring 51 in the direction of the coupling position, then engages again into its first coupling position, in which the stepped offset portion 42 which is nearest the pin articulation 38 engages over the catch lug 44. When the pistons 30 and 31 are moved further forwards, the slave lever 37 is also displaced again beneath the holding-down stirrup 45, so that uncoupling is no longer possible between the two pistons 30 and 31. This piston position corresponds to the operating position shown in FIG. 2, in which a new rivet 1 can be placed over the two tongues 4 and 5, which can now be bent together. Placing of the rivet 1 is facilitated by the two lateral projections 7 of the tongues being provided with run-on bevels 52.

If the hand lever 22 is now opened still further, it strikes a triggering pin 53 which pivots the locking lever 48 against the force of the compression spring 50, as a result of which the catch stop 49 moves out of the movement path of the slave piston 32 and releases the latter. The force of the spring 36 now predominates and presses the slave piston 32 against the drive piston 30 again, as a result of which the supporting element 6 is moved forwards between the tongues 4 and 5. The riveting mandrel 2 now assumes the position shown in FIG. 4. Directly afterwards, the opening-out operation of the rivet end can be started by closing the tongs, that is, by pivoting the hand lever 22 in the direction of the handle 21 and by the movement caused thereby of all three pistons 30, 31 and 32 to the right.

An additional tension spring 54, which is secured in position between the drive piston 30 and the working-side end of the housing, exerts via the drive piston a pretensioning force, directed to the left in the drawing, on the tongue piston and consequently on the tongues 4 and 5, thus ensuring that when a hollow rivet 1 is placed onto the riveting mandrel 2 it cannot be pushed back.

I claim:

1. A device for setting blind rivets provided with cylindrical, continuous hollow spaces and rivet heads, for connecting inner and outer structural parts which are accessible only on one side and are provided with bores in alignment with one another comprising:

a riveting mandrel having a thickened end, the diameter of which, at least in one dimension, is larger than the diameter of the cylindrical rivet hollow space, a holding-down part having a central bore in which the riveting mandrel is guided in an axially displaceable manner, a pulling device for displacing the riveting mandrel in the direction out of the rivet hollow space, said riveting mandrel comprising:

two flexible tongues which extend in the mandrel longitudinal direction, said tongues each including a free end on their sides pointing radially outwards and projections at the free ends thereof, said projections forming the thickened end, a supporting element extending in the mandrel longitudinal direction provided between the tongues, said supporting element being displaceable in the longitudinal direction of the riveting mandrel relative to the tongues, said supporting element being movable between a forward position for opening out the rivet end and a pulled-back position for pulling the mandrel out of the rivet hollow space after the rivet end is opened out, wherein when said supporting element is in the forward position, the supporting element is located in a position which is pushed forwards relative to the tongues and between the free ends of the tongues which are provided with the projections, and when said supporting element is in the pulled-back position, the tongue ends provided with the projections can be tilted towards one another.

wherein said drive mechanism comprises:

a drive piston quided in an axial direction of the riveting mandrel and mounted in a guide channel made in a tong housing, a tongue piston bearing said tongues and arranged on a side of said drive piston pointing towards the working end of the riveting tool, a slave piston provided on a side of said drive piston remote from the working end, wherein said supporting element extends through central bores provided in all three pistons, projects through the slave piston and bears with a head against the side of the slave piston remote from the working end, and all three pistons are adapted to be coupled to one another selectively, dependent on the rivet setting operation.

2. The device according to claim 1, wherein said riveting mandrel includes two tongues each having a cross-section in the shape of a circular segment, and said supporting element has a flat, rectangular cross-section, the width of which approximately corresponds to that of the tongues.

3. The device according to claim 1, further comprising a riveting tool comprising said holding-down part and said riveting mandrel, said riveting tool comprising a tong housing, said holding-down part being firmly fixed to the tong housing, and said tongues and said supporting element being independently actuable with respect to one another.

4. The device according to claim 3, further comprising means for adapting movement of said tongues and said supporting element to each other dependent on the setting operation.

5. The device according to claim 3, further comprising:

a common spring device for pretensioning said tongues and said supporting element into their position extended at a point as far as possible from said holding-down part, and a common drive mechanism for displacing the riveting mandrel parts, wherein the riveting mandrel parts can be individually selectively uncoupled from said drive mechanism dependent on the setting operation.

6. The device according to claim 1, further comprising:

locking means for locking the slave piston in the area of the guide channel remote from the working end for placing a blind rivet onto the riveting mandrel, and moving means for moving the drive piston together with the tongue piston in the direction of the working end of the riveting tool;

7. The device according to claim 1, further comprising coupling means for coupling all three pistons to one another and moving the pistons away from the working end of the tool for opening out the rivet end.

8. The device according to claim 7, further comprising means for uncoupling the tongue piston bearing the tongues from the drive piston after the rivet end is opened out.

9. The device according to claim 8, further comprising means for re-coupling the tongue piston to the drive piston for pulling the riveting mandrel out of the rivet hollow space.

10. The device according to claim 9, wherein the uncoupling and subsequent re-coupling of the tongue piston to the drive piston are effected dependent on the position of the drive piston and are selectively adjustable.

11. The device according to claim 3, wherein said drive piston comprises a slave recess and said device further comprises:

one tong leg rigidly connected to the tong housing, and another tong leg, forming a two-arm lever, articulated on the tong housing and having a fork-shaped actuating end engaging into the slave recess of the drive piston.

12. The device according to claim 11, wherein said device comprises manually operable riveting tongs and said another tong leg is shorter than said one tong leg.

13. The device according to claim 1, wherein said supporting element has a substantially constant diameter along the length thereof which corresponds substantially to the length of the at least two tongues.

14. A device for implementing a method of setting blind rivets provided with cylindrical, continuous hollow spaces, preferably for connecting structural parts which are accessible only on one side and are provided with bores in alignment with one another, comprising:

a riveting mandrel, having a thickened end having a diameter which is larger in one dimension than the diameter of the cylindrical rivet hollow space;

two flexible tongues, forming the riveting mandrel, which extend in the mandrel longitudinal direction, the tongues having projections at their free ends, on their sides pointing radially outwards, which form the thickened end;

a pulling device for displacing the riveting mandrel in the direction out of the rivet hollow space;

a supporting element provided between the tongues which also extends in the mandrel longitudinal direction, said supporting element being displaceable in the longitudinal direction of the riveting mandrel relative to the tongues, said supporting element being movable between a forward position at least for opening out the rivet end in which said supporting element is pushed forwards relative to the tongues and is also located between the free ends of the tongues provided with the projections, and a pulled-back position for pulling the mandrel out of the rivet hollow space, after the rivet end is opened out, in which the tongue ends provided with the projections can be tilted towards one another;

a holding-down part with a central bore, in which the riveting mandrel is guided displaceable in axial direction;

a tong housing, the holding-down part and the riveting mandrel being parts of a riveting apparatus, the holding-down part being firmly fixed to the working end of the tong housing, and wherein the tongues on the one hand and the supporting element on the other hand can be actuated independently of one another;

a common spring device for pretensioning the tongues and the supporting element into their position extended the furthest out of the holding-down part;

a common drive mechanism for displacing the riveting mandrel parts, wherein the riveting mandrel parts can be individually selectively uncoupled from the drive mechanism, depending on the setting operations; and wherein the drive mechanism comprises a drivable piston, which is guided in axial direction of the riveting mandrel and is mounted in a guide channel made in the housing of the riveting tool, a piston bearing the tongues arranged on the side of the drivable piston pointing towards the working end on the riveting tool, and a slave piston provided on the side of the drive piston remote from the working end, and wherein the supporting element extends through central bores provided in all three pistons, projects through the slave piston and bears with a head against the side of the slave piston remote from the working end, and the three pistons can be coupled to one another selectively, depending on the rivet setting operation.

15. The device according to claim 14, wherein the tongues of the riveting mandrel have a cross section in the shape of a circular segment, and the supporting element has a flat, rectangular cross section, the width of which approximately corresponds to that of the tongues.

16. The device according to claim 14, wherein the movements of the tongues and the supporting element can be adapted to one another depending on the setting operation.

17. The device according to claim 14, further comprising means for locking the slave piston in the area of the guide channel remote from the working end for placing a blind rivet onto the riveting mandrel, and means for moving the drivable piston together with the tongue piston in the direction of the working end of the tool.

18. The device according to claim 14, further comprising means for coupling all three pistons to one another and moved away from the working end of the tool for opening out the rivet end.

19. The device according to claim 18, further comprising means for uncoupling the piston bearing the tongues from the drivable piston after the opening-out operation is complete.

20. The device according to claim 19, further comprising means for recoupling the tongue piston to the drivable piston in order to pull the riveting mandrel out of the rivet hollow space.

21. The device according to claim 20, wherein said means for uncoupling and subsequent re-coupling of the tongue piston to the drivable piston comprise means for effecting the uncoupling and recoupling dependent on the position of the drivable piston, said uncoupling and re-coupling means being selectively adjustable.

22. The device according to claim 14, wherein the device is operable as a manually operable riveting tongs, wherein one tong leg comprising a handle is rigidly connected to the tong housing and the other tong leg comprising a hand lever forming a two-arm lever, is articulated on the tong housing, the short lever, with a fork-shaped actuating end, engaging into a slave recess of the drivable piston.

* * * * *